US006647799B1

(12) United States Patent
Raper et al.

(10) Patent No.: US 6,647,799 B1
(45) Date of Patent: Nov. 18, 2003

(54) SOIL STRENGTH MEASUREMENT FOR SITE-SPECIFIC AGRICULTURE

(75) Inventors: Randy L. Raper, Auburn, AL (US); Eric H. Hall, Auburn, AL (US)

(73) Assignees: The United States of America as represented by the Secretary of Agriculture, Washington, DC (US); Auburn University, Auburn, AL (US)

( * ) Notice: Subject to any disclaimer, the term of this patent is extended or adjusted under 35 U.S.C. 154(b) by 0 days.

(21) Appl. No.: 10/050,486

(22) Filed: Jan. 16, 2002

(51) Int. Cl.[7] ..... G01B 5/00
(52) U.S. Cl. ..... 73/784; 73/73
(58) Field of Search ..... 73/784, 73, 155, 73/170.34, 78–85; 364/505; 702/12; 340/854.6; 175/40, 84, 6; 111/89; 324/621, 354; 181/121; 362/157; 395/823; 239/63

(56) References Cited

U.S. PATENT DOCUMENTS 4,284,150 A * 8/1981 Davis ..... 175/84
4,654,598 A * 3/1987 Arulanandan et al. ..... 324/354
5,456,325 A * 10/1995 Pantermuehl et al. ..... 175/6

OTHER PUBLICATIONS

T. Alihamsyah et al., On–The–Go Soil Mechanical Impedance Measurements, Proceeding of the 1991 Symposium, Automated Agriculture for the 21st Century, Dec. 16–17, 1991, Chicago, Illinois.

M. Weissbach et al., The Horizontal Penetrograph–Big Scale Mapping Device for Soil Compaction, Proceeding of the 3rd International Conference on Soil Dynamics, Aug. 3–7, Tiberias, Israel, Faculty of Agricultural Engineering Technion, Haifa, Israel.

R.L. Raper et al., A Tractor–Mounted Multiple–Probe Soil Cone Penetrometer, 1999 Applied Engineering in Agriculture, vol. 15(4):287–290.

G. Manor et al., Development of an Instrumented Subsoiler to Map Soil Hard–Pans and Real–Time Control of Subsoiler Depth, American Society of Agricultural Engineers, Written Presentation for Jul. 30–Aug., 2001, Sacramento, California.

D. Sirjacobs, et al., On–line Soil Mechanical Resistance Mapping and Correlation with Soil Physical Properties for Precision Agriculture, Soil & Tillage Research, 2002, vol. 64, pp. 231–242.

* cited by examiner

*Primary Examiner*—Edward Lefkowitz
*Assistant Examiner*—Octavia Davis
(74) *Attorney, Agent, or Firm*—John D. Fado; Randall E. Deck

(57) ABSTRACT

An apparatus and method are provided for continuously measuring the soil strength on-the-fly and at different depths. The apparatus includes a downwardly extending probe having an impedance sensor mounted on a leading edge thereof so as to be impacted by the soil as the probe is moved in a horizontal direction therethrough. A reciprocating drive is also provided which is effective for simultaneously oscillating the probe in an up and down movement while it is passing horizontally through the soil. The mechanical impedance exerted upon the sensor is then measured as the probe is passed both horizontally and up and down through said soil, thereby providing a continuous depth-variable profile of the soil strength over a large area.

11 Claims, 6 Drawing Sheets

SOIL STRENGTH MEASUREMENT FOR SITE-SPECIFIC AGRICULTURE

BACKGROUND OF THE INVENTION

1. Field of the Invention

The invention relates to a device and method for measuring soil strength in a field.

2. Description of the Prior Art

Root-restricting soil layers reduce crop yields in the southeastern United States almost every year due to temporary periods of drought. These root-restricting layers are characterized by a high mechanical impedance. Research has shown that excessive values of mechanical impedance can have detrimental effects on root growth and crop yield [Taylor and Gardner, 1963, Penetration of cotton seedling taproots as influenced by bulk density, moisture content, and strength of soil. Soil Sci. 96(3): 153–156; and Bowen, 1976, Correlation of penetrometer cone index with root impedance. ASAE Paper No. 76-1516, ASAE, St. Joseph, Mich.]. Tillage beneath these layers is an annual practice for most farmers in this region as a method of removing this barrier and improving rooting conditions. Tillage practices facilitate control of the root-restricting layers by a modifying or reducing the mechanical impedance of the soil.

In the past, methods of prescribing tillage operations have often been based on preventive maintenance, rather than diagnostic evidence. However, researchers have recognized the inherent inefficiency of such tillage treatments and have proposed tillage systems where the soil prescribes the necessary tillage treatment to alleviate mechanical impedance problems. These systems require determination of the soil mechanical impedance to determine the tillage needed [Bowen and Coble, 1967, Environment requirement for germination and emergence. TRANSACTIONS of the ASAE 11(12):10–24; and Schafer et al., 1981, Control concepts for tillage systems. ASAE Paper No. 81-1601. ASAE, St. Joseph, Mich.].

Currently, soil cone penetrometers are used to measure the mechanical impedance of the soil and determine the depth of the root-restrictive layer. Typically, measurements are conducted at a few locations within a field and the tillage depth is then set to exceed the deepest root-restricting layer.

The first version of the cone penetrometer was developed by the U.S. Army Corp of Engineers Waterways Experiment Station (WES) to predict trafficability of soil to vehicles (Knight, 1948, Trafficability of soils—laboratory tests to determine effects of moisture and density variations. Tech. Memo 3-240, 1$^{st}$ supplement. U.S. Army Corp of Engineers Waterways Experiment Station, Vicksburg, Miss.). In brief, the cone penetrometer measures the force required to insert a cone tip into the soil. The force required to insert the tip is converted to cone index by dividing the insertion force by the area of the base of the cone tip. This cone index thus provides an empirical measurement of soil state.

While the cone index provides an accurate measurement of the soil condition at the site of the test, use of the cone penetrometer is not practical for the determination of soil compaction on a large scale field setting [Raper et al., 1999, A tractor-mounted multiple-probe soil cone penetrometer, Applied Engineering in Agriculture 15(4):287–290]. A dense sampling scheme must be used, if the true variation of soil compaction within a field is to be determined. Researchers have attempted to design sampling tools which can determine soil compaction fast enough to permit field scale mapping of soil compaction. Raper et al. (1999, ibid) developed a tractor mounted penetrometer with multiple probes to allow the determination of soil strength profiles quickly across the row. However, while this device increased the penetrometer data collection, the stop-and-go insertion method still was not fast enough to obtain valid data in intensive sampling situations.

Intrusive and non-intrusive methods have been developed for on-the-fly impedance measuring. Ground Penetrating Radar (GPR) and Electrical Conductivity (EC) have been investigated as a means of non-intrusive on-the-fly determination of subsurface soil properties and features [Raper et al., 1990, Sensing hard pan depth with ground-penetrating radar. TRANSACTIONS of the ASAE 33(1):41–46; and Boll et al., 1994, Using ground-penetrating radar to detect layers in a sandy field soil. ASAE Paper No. 94-2513, ASAE, St. Joseph, Mich.].

Several on-the-fly techniques have also been developed which are soil intrusive. Attempts have been made to quantify soil conditions with draft [Young et al., 1988, Quantifying soil physical condition for tillage control applications. TRANSACTIONS of the ASAE 31(3):662–667; and Smith et al., 1994, Using coulters to quantify the soil physical condition. ASAE Paper No. 941040. ASAE, St. Joseph, Mich.]. Smith et al. used coulters to attempt to quantify the soil physical condition. Alihamsyah et al. (1990, A Technique for Horizontal Measurement of Soil Mechanical Impedance. ASAE Paper No. 90-12201. ASAE, St. Joseph, Mich.) developed and tested a horizontal operating blade with an impedance-sensing tip. This prototype tested two tip designs, a standard 30° cone and a 30° wedge. Both tip designs were tested against a standard vertically operated cone penetrometer. The 30° wedge was found to most closely correlate to the standard cone penetrometer. In field tests, Alihamsyah and Humphries (1991, On-the-go soil mechanical impedance measurements. In *Proc. Of the* 1991 *Symp.: Automated Agriculture for the* 21$^{st}$ *Century*, 16–17 December, Chicago, Ill. ASAE, St. Joseph, Mich.) determined that the horizontal blade with a 30° wedge was most suitable for further development. More recently, Chukwu and Bowers (1999, Instantaneous multiple depth soil mechanical impedance sensing from a moving vehicle, Unpublished) developed a multiple probe horizontal blade penetrometer with a 30° wedge for testing probes. This unit was able to detect impedance values at three distinct depths. Weissbach and Wilde also developed a device similar in concept to that described by Alihamsyah to detect soil compaction on-the-fly (Weissbach and Wilde, 1997, The horizontal penetrograph-big scale mapping device for soil compaction. In *Proc. of the* 3$^{rd}$ *International Conference on Soil Dynamics*, 3–7 August, Tiberias, Israel. Faculty of Agricultural Engineering Technion, Haifa, Israel).

While the horizontal penetrometer designs which have been developed have allowed for improved measurement of have impedance, measurements are only taken at discrete depths. There remains a need for a system which would allow impedance to be measured continuously throughout the soil profile.

SUMMARY OF THE INVENTION

We have now invented a novel apparatus and method for continuously measuring the soil strength on-the-fly and at different depths. The apparatus includes a downwardly extending probe having an impedance sensor mounted on a leading edge thereof so as to be impacted by the soil as the probe is moved in a horizontal direction therethrough. A reciprocating drive is also provided which is effective for simultaneously oscillating the probe in an up and down movement while it is passing horizontally through the soil. The mechanical impedance exerted upon the sensor is then measured as the probe is passed both horizontally and up and down through said soil, thereby providing a continuous depth-variable profile of the soil strength over a large area.

In accordance with this invention, it is an object to provide an improved on-the-fly apparatus and method for measuring soil strength and compaction.

It is also an object of this invention to provide an on-the-fly apparatus and method for completely measuring soil strength throughout the soil profile over large areas.

Another object of this invention to provide an apparatus and method for rapidly measuring soil strength throughout the soil profile as device is pulled across a field.

Yet another object of this invention is to provide an apparatus and method for continuously measuring soil strength throughout the soil profile.

Other objects and advantages of the invention will become readily apparent from the ensuing description.

DETAILED DESCRIPTION OF THE INVENTION

Figure 1:
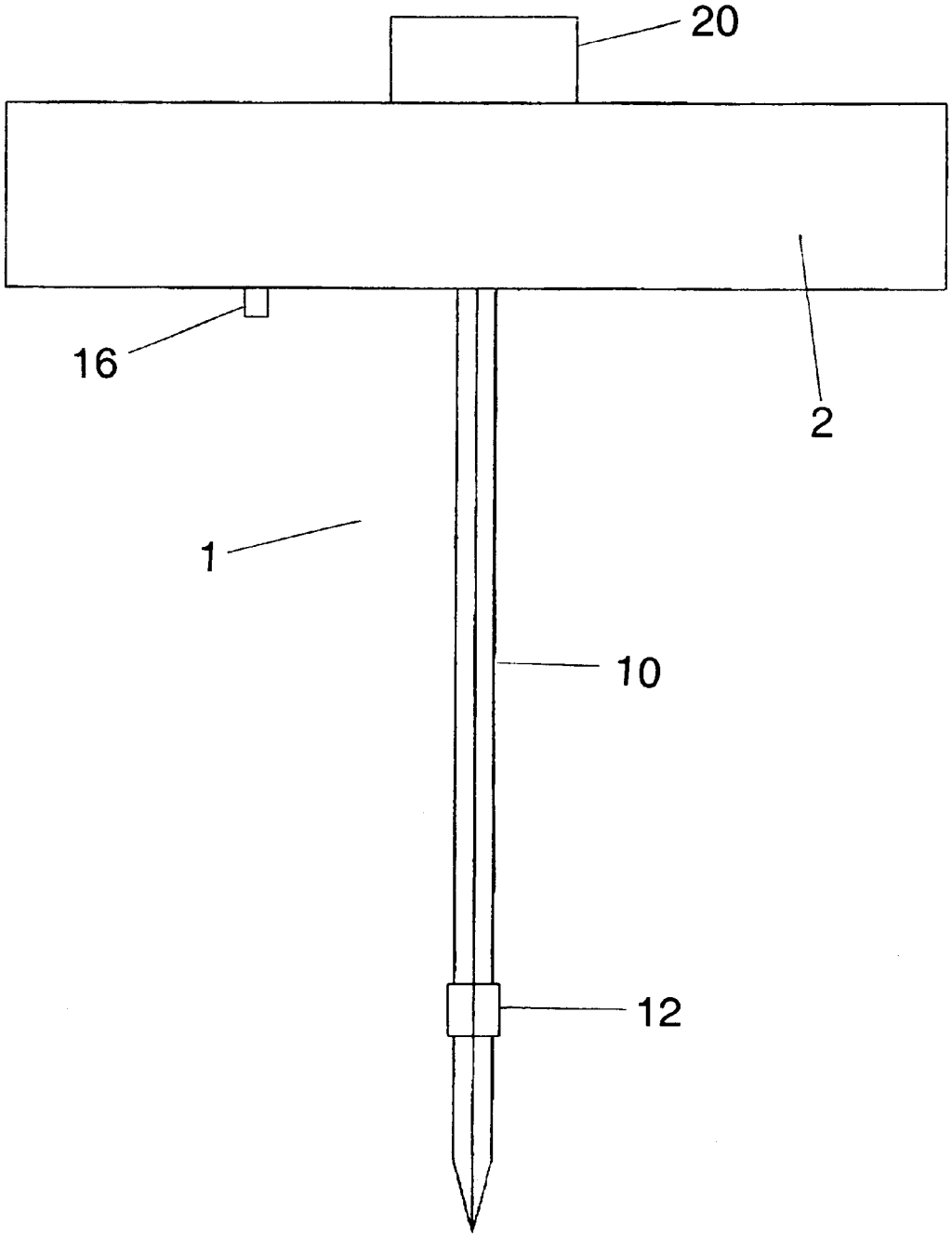
FIG. 1 is a front view of the apparatus of the invention for measuring mechanical impedance of the soil.

The apparatus for measuring soil strength of this invention is adapted to simultaneously record depth and mechanical impedance force while it is pulled in a horizontal direction through the soil. In addition to this horizontal motion, the apparatus may be oscillated in a vertical direction so that mechanical impedance can be measured continuously throughout the soil profile.

Referring now to the Figures, the apparatus includes at least one horizontal mechanical impedance detector 1 for attachment to a frame or tool bar 2. Frame 2 is itself adapted for connection to a tractor, vehicle, ground-traversing carriage, or other agricultural implement such as ahead of a tiller. Each impedance detector 1 includes a downwardly extending probe or tine 10 having a leading edge 11 which is exposed to the soil as the tine is passed through the soil in the direction indicated by the arrow. An impedance sensor or sensing tip 12 is positioned on the leading edge 11 of the probe 10 facing the direction of travel, whereupon it is exposed to and impacted by the soil as the probe is advanced forward in a horizontal direction therethrough. A load cell or force transducer 13, such as a strain gauge or pressure gauge, is provided in communication with the impedance sensor for detecting and quantifying the horizontal force which is exerted upon the sensor by the soil as the probe is moved. To allow the soil impedance to be measured at different depths throughout the soil profile, a reciprocating drive 20 is provided which is effective for oscillating the probe up-and-down through the soil as the probe is simultaneously moved horizontally therethrough.

The size and shape of the probe 10 are not critical, and a variety of probes are suitable for use herein. Without being limited thereto, probes may be straight, bent, or curved, and may be disposed substantially vertically or inclined at an angle to the vertical. The cross section of the probe may also be varied, and probes having substantially flat or curved leading edges 11 may be used, although probes having a pointed or wedge shaped leading edge are preferred to facilitate soil penetration.

Figure 2:
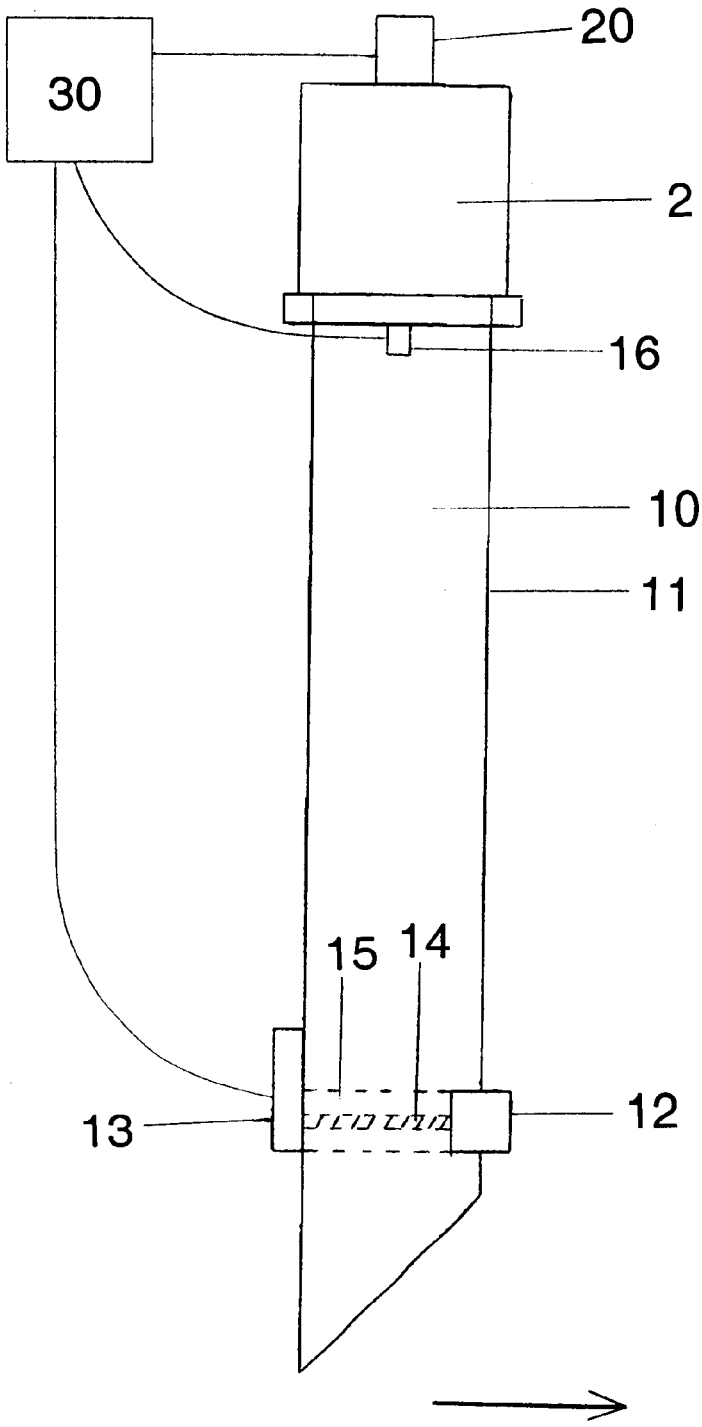
FIG. 2 is a side view of the apparatus of FIG. 1.

The impedance sensor 12 is also not critical, and a variety of conventional impedance sensors may be effective for sensing the horizontal force exerted by the soil, and thus are suitable for use in the detector 1. The particular impedance sensor selected, including its size, shape, and position with respect to the probe, may vary with different soil types and conditions, and may be readily determined by routine experimentation. As shown in FIGS. 1 and 2, the use of a wedge-shaped impedance sensor extending forward of the leading edge 11 is preferred. However, other suitable sensors include, but are not limited to cylinders or bars with flat, rounded, pointed, or conical faces, and may be flush with or extend forward of leading edge 11. In the preferred embodiment, sensor 12 contacts load cell 13 attached to the back side of the probe through rod 14 which is passed through hole 15 in probe. Horizontal force experienced by the sensor is thus directly transmitted to the load cell for detection and quantification.

To correlate the mechanical impedance measured to soil depth, the depth of the sensor 12 may be measured using a variety of optical, electronic, or mechanical instruments conventional in the art. In the preferred embodiment, depth may be measured using an optical sensor 16 attached to frame 2 or probe 10 which is effective for measuring the distance to the ground.

Figure 3:
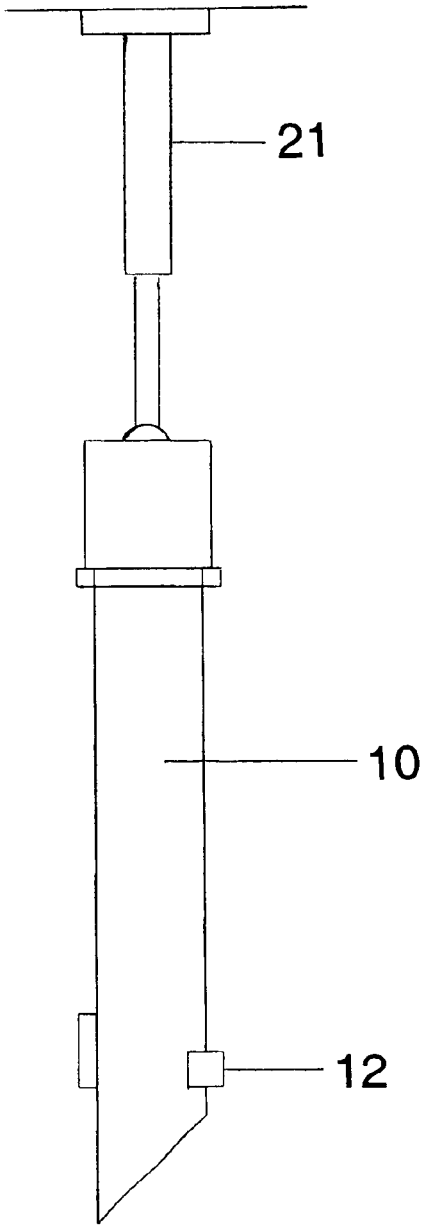
FIG. 3 is a side view of the apparatus of FIG. 1 with a reciprocating drive of a first embodiment.
Figure 4:
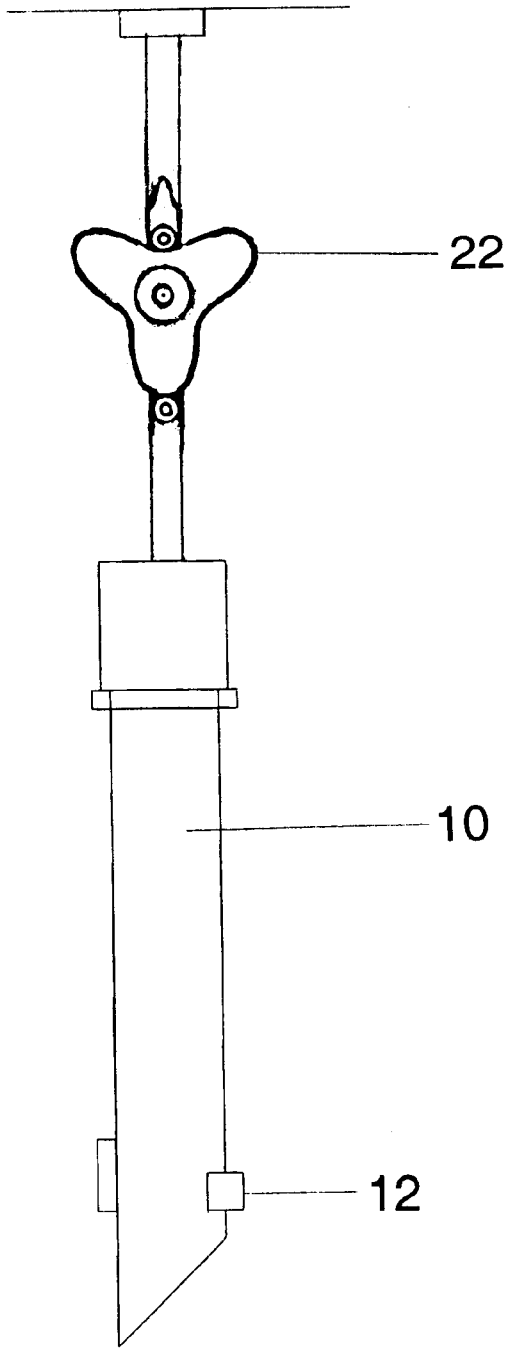
FIG. 4 is a side view of the apparatus of FIG. 1 with a reciprocating drive of a second embodiment.
Figure 5:
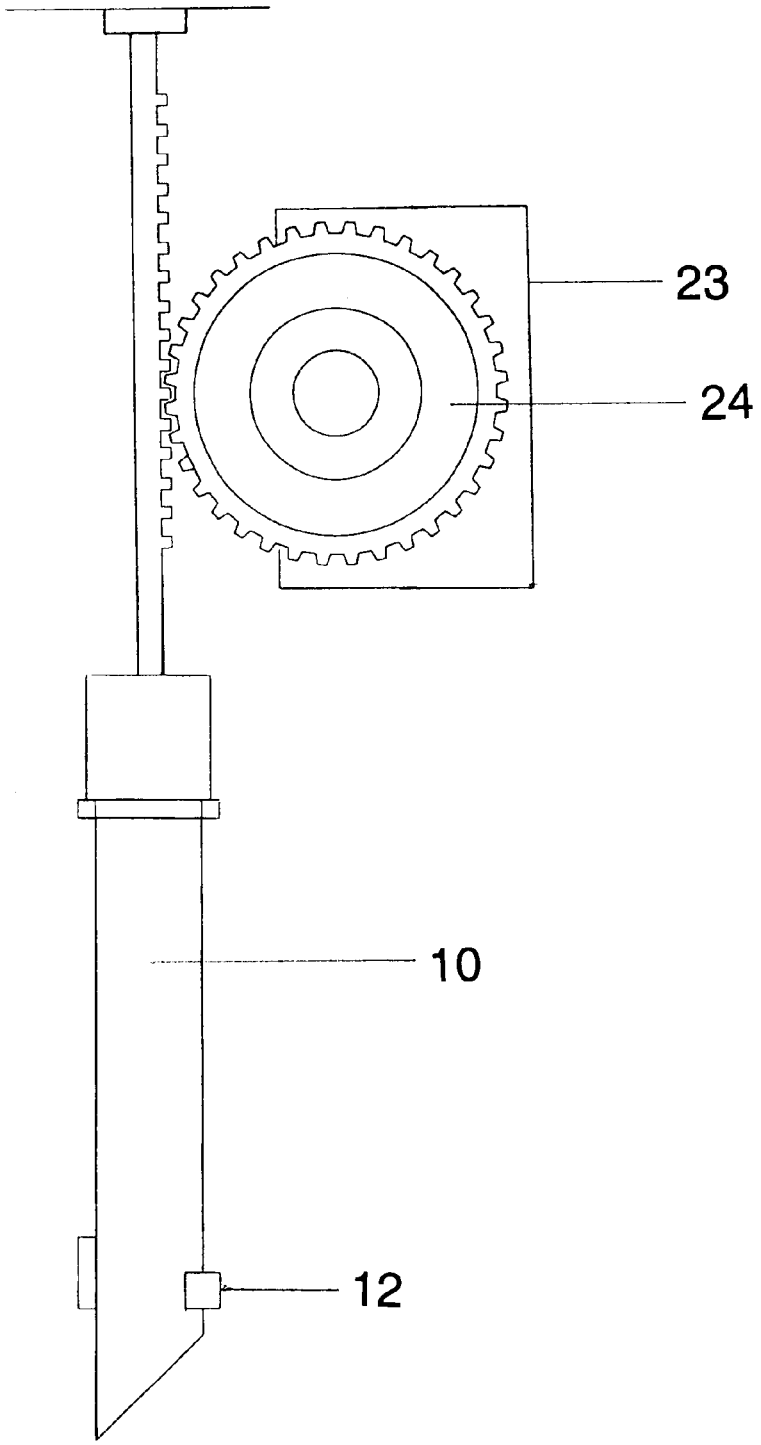
FIG. 5 is a side view of the apparatus of FIG. 1 with a reciprocating drive of a third embodiment.
Figure 6:
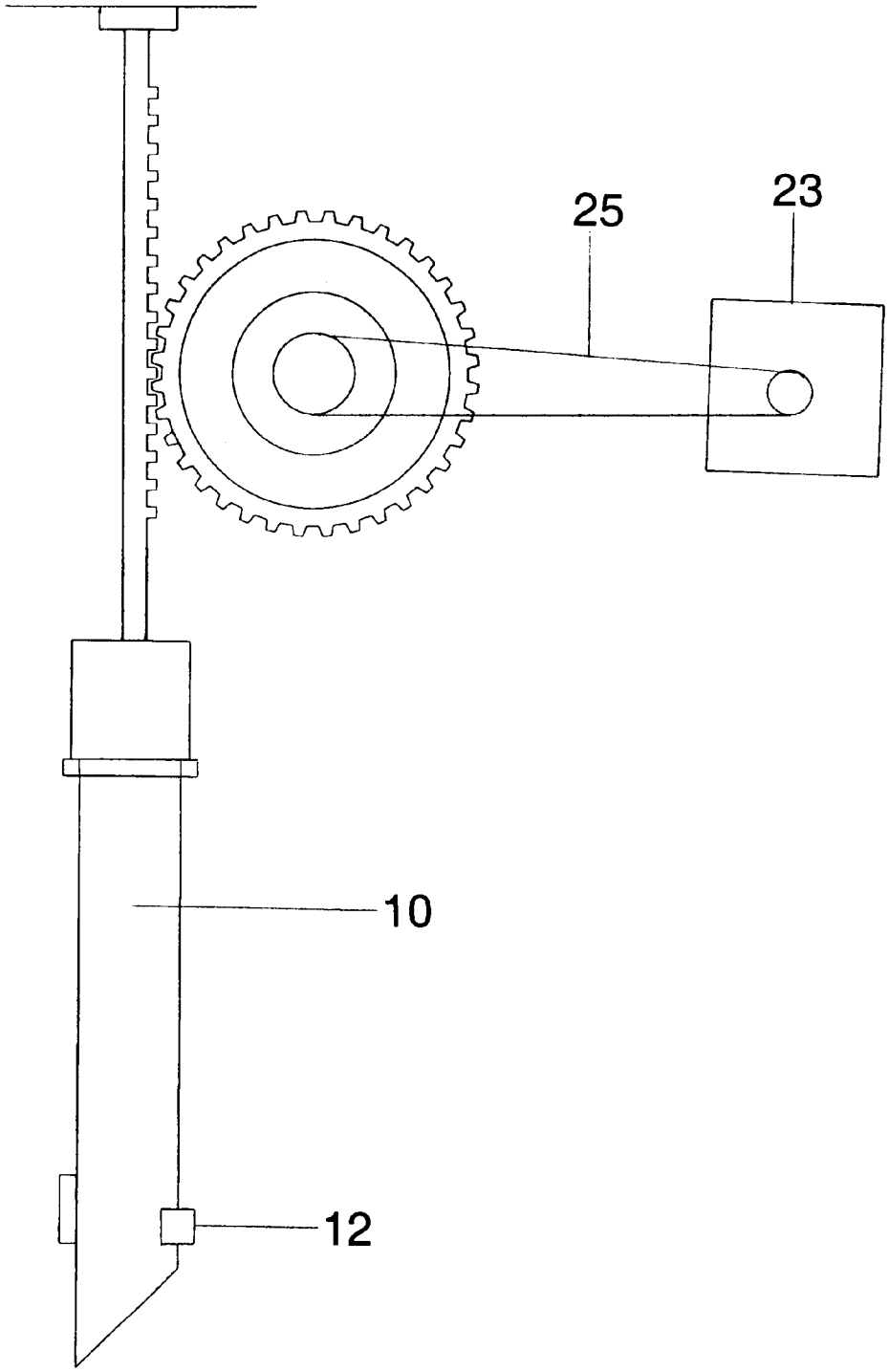
FIG. 6 is a side view of the apparatus of FIG. 1 with a reciprocating drive of a fourth embodiment.

Movement of the probe vertically through the soil is effected by reciprocating drive 20 attached directly or indirectly to frame 2 or probe 10. In the preferred embodiment shown in FIG. 3, the reciprocating drive includes one or more extensible/retractable elements 21 such as hydraulic or pneumatic cylinders. Alternatively, other conventional drives could be employed for effecting the oscillating movement including but not limited to various cams 22 (FIG. 4), or one or more motors 23 with cooperating gears 24 (FIG. 5) or belts 25 (FIG. 6). In the latter embodiments, a single reversible motor, or two alternating motors operating in opposite directions may be used. In each of these embodiments, actuation of the reciprocating drive will typically be electronically controlled.

Control of the reciprocating drive 20, including its actuation, rate of oscillation (defined herein as the number of up/down movements or cycles per foot traversed in the horizontal direction), the frequency of measurements, and the range of vertical motion (i.e., the profile or the upper and lower depth limits) of sensor 12 through the soil, is preferably effected by a microprocessor 30 provided in communication with the drive. Microprocessor 16 may be a microprocessor based computer control unit (central processing unit) having conventional interface hardware for receiving and interpreting signals from the load cells 13 and depth sensor 16, and an input allowing communication with the user. The microprocessor may then be programmed to actuate the reciprocating drive at a desired oscillation rate and range of vertical motion, as well as the frequency of measurements.

Without being limited thereto, in the preferred embodiment, the microprocessor will be programmed to cause the probe to move at an oscillation rate and across a vertical range which is at least about 6 to 18 inches high (i.e., the difference between the upper and lower depth limits) at least one time (i.e., at least one half of one up and down cycle) for every 25 feet of horizontal movement across the field. The particular upper and lower depths selected for the vertical range will vary with the soil type, conditions, and crop, and may be readily determined by the user. The oscillation rate may also be increased as desired. Although the use of microprocessor control is preferred, the skilled practitioner will recognize that the rate of oscillation and the range of vertical motion may also be changed manually without use of a microprocessor, for example, by adjusting the stroke, speed, and/or size of the reciprocating drive 20 and/or changing the length of probe 10.

Soil impedance measurements generated by the load cell may be displayed and/or stored using one or both of an optional monitor and recording instrument such as a printer in communication with the microprocessor 30. The microprocessor 30 may also be provided with conventional mapping software for generating maps showing a spatial representation of the measured data across the field traversed. Alternatively, measurements may be displayed using conventional soil strength recording instruments.

The apparatus of the invention may collect mechanical impedance data continuously or intermittently at predetermined intervals as it traverses the field. If not preset, the desired oscillation rate, soil profile or range of vertical motion (the upper and lower depth limits), and the measurement frequency may be selected by the user. In operation, the frame 2 is lowered from its transportation position such that the probe 10 and impedance sensor 12 contact and penetrate the ground to the desired starting depth for measurements of soil strength. The reciprocating drive 20 may then be actuated manually or automatically, causing the probe to oscillate up and down (with the impedance sensor remaining in said soil) across the predetermined soil depth profile, simultaneously as the probe is passed horizontally through the soil. The mechanical impedance exerted upon the impedance sensor as the probe is passed both horizontally and up and down through the soil is measured and recorded. Thus, an infinite number of depths may be measured within the soil profile.

Soil may be tilled simultaneously with or following the measurements. In the preferred embodiment, tillage may thus be performed only where needed, and the appropriate tillage depth may be adjusted on-the-fly in accordance with changes in the soil strength across the field.

The following examples are intended only to further illustrate the invention and are not intended to limit the scope of the subject matter which is defined by the claims.

EXAMPLES

Materials and Methods

For measurement of soil mechanical impedance, the apparatus was constructed with a sensing tip, a tine, and a force transducer as shown in FIGS. 1 and 2.

Three 30° prismatic wedge tips were designed and tested with the apparatus. A 30° prismatic wedge design was chosen based on work by Alihamsyah and Humphries (1991, ibid), who had concluded that the 30° prismatic wedge was the optimum geometric shape for horizontal determination of mechanical impedance.

The original sensing tip design was formed from 25-mm bar stock. The tips produced from the 25-mm bar stock had a cross-sectional base area of 625 $mm^2$ and were built in two lengths. One was flush with the leading edge of the tine, to allow vertical movement through the soil profile without adding vertical forces to the tine. The second tip protruded 30 mm in front of the advancing tine. This protruding tip was built to determine if the position of the tip affected mechanical impedance measurements of the apparatus. The impedance tips were connected to the force transducer by a 16-mm shank, which passed through an oversized hole drilled in the tine.

In tests at the USDA National Soil Dynamics Laboratory indoor Norfolk sandy loam soil bin with the 625 $mm^2$ tip, sufficient forces for accurate impedance measurements with the tip/load cell combination were not encountered in all soil conditions. To remedy this problem, two possible solutions were considered. The first was to resize the force transducer. The second option was to increase the size of the impedance sensing tip. Because, the force transducer used in this project was the smallest design commercially available, resizing the tip was chosen as the appropriate remedy. A 2500 $mm^2$ tip was built from 50 mm bar stock. The 2500 $mm^2$ tip protruded 30 mm in front of the leading edge of the tine. Initial testing of the 625 $mm^2$ tips indicated that the tip is preferably located in front of the advancing tine to obtain accurate impedance measurements. The tine caused the soil to fracture in front of the tip thus reducing the forces on the tip. Material was removed from the top and bottom of the 2500 $mm^2$ tip to allow the tip to recess in the slot in the tine that was cut for the 625 $mm^2$ tips.

The tine of the apparatus was built from 37.5 mm×150 mm A-36 plate steel, with a total tine length of 900 mm. .The tine was designed to be pulled. at a perpendicular rake angle to the soil surface, while allowing the sensor to have a maximum effective measuring depth of 600 mm. The width of 37.5 mm was selected because the force transducer was 36.5 mm wide, therefore the tine was wide enough to protect the transducer. To limit the formation of a soil wedge in front of the advancing tine, the leading edge of the tine was beveled to form a 30° prismatic wedge similar to the impedance sensing tips. To facilitate penetration into the soil profile, the bottom of the tine was cut on a 45° angle and beveled to a 30° prismatic wedge. A 30 mm tall×50 mm deep section was removed from the front of the tine to position the 625 $mm^2$ impedance tip flush with the leading edge of the tine. A 20-mm hole was drilled through the center of the removed section. This hole allowed the shank of the impedance tip to pass through the tine unobstructed and connect to the force transducer. The back of the tine also had two holes drilled and tapped to allow the force transducer to be attached with bolts. A 37.5 mm×6.4 mm wall thickness, square tube cable protector was welded to the rear of the tine to prevent damage to the force transducer cable.

The force transducer chosen for the apparatus was a SENSOTEC® GR3 load beam (SENSOTEC®, Columbus, Ohio 43228), with a 4.45 kN measurement capacity. The transducer capacity was selected to accommodate the range of forces expected from the two tip sizes. The GR3 load beam is a cantilever beam design, capable of measuring tensile and compressive loads.

Data acquisition was accomplished with a Modcomp data acquisition system. For tests with the mechanical impedance sensor, the system was set to sample the force transducer twenty-five times a second. The force transducer was calibrated to the Modcomp system using a 4.45 kN Tension or Compression Morehouse Proving Ring (Morehouse Instrument Company, York, Pa. 17403).

Dynamic movement of the tine was accomplished with the dynamometer car. This car has the capability to move a tillage tool upward or downward in the soil as the car traversed the soil bin. During testing where the apparatus was oscillated through the soil profile, depth was recorded by a depth recording motor (Celseco Transducer Products Inc., Canoga Park, Calif.).

Evaluation of the apparatus was conducted in the Norfolk sandy loam (fine-loamy, siliceous, thermic Typic Paleudults) indoor soil bin at the USDA National Soil Dynamics Laboratory. The Norfolk sandy loam soil bin was 7-m wide, 58-m long and 1.5-m deep, with a particle size distribution of 71.6% sand, 17.4% silt and 11% clay. The soil was uniform in mechanical composition, i.e., natural profiles are not reproduced in the bin. The indoor soil bin was selected because moisture content within the soil was controllable in this environment. The soil bin was prepared differently for each experiment with the apparatus.

The first three experiments were designed to test the ability of the apparatus to measure impedance at constant depths. The fourth experiment was designed to assess the ability to measure impedance as the tool moves through the soil profile.

Formation of compacted soil layers, commonly referred to as pans, were desired for the experiments with the apparatus. The following procedures were used to achieve the formation of the pans. A roto-tiller operating at a depth of 450 mm was used to loosen the soil and remove any residual soil layers from previous experiments. The soil was then wetted to field capacity, roto-tilled to uniformly mix the soil, and compacted with a large roller. After the first pan was created, the soil surface was leveled and the soil was roto-tilled above the pan. Another deep tillage pan could then be created at a slightly shallower depth by following the same procedure, or shallow compaction can be added using the V-wheel roller.

A uniform dense soil condition was produced for the first three experiments with the apparatus. This soil condition was created by first rotor tilling the soil to a depth of 450 mm and then creating a pan at a depth of 300 mm. The soil was then roto-tilled above the 300 mm pan and a second pan was created at a depth of 150 mm. The soil was then roto-tilled above the 150 mm pan and shallow compaction was added with the V-wheel roller. The soil surface was then leveled and then flat rolled.

A soil profile with one pan was created for the fourth experiment. This condition allowed comparison on how well the detected and vertically referenced mechanical impedance as compared to a cone penetrometer. The pan was created at a depth of 200 mm and shallow compaction was again applied with the V-wheel. The soil surface was leveled and flat rolled.

In the first three experiments assessing the ability of the sensor to determine mechanical impedance at static depth positions, a randomized complete block experimental design was implemented with four replications of four treatment depths. The treatment depths were 100 mm, 175 mm, 250 mm, and 325 mm. The depths were selected so that the 175 mm and 325 mm depths would be 25 mm below the tillage induced pans. These depths were where maximum soil density caused by the pan was expected. The pan thickness was approximately 25 mm thick. This experiment would also determine if depth affected the ability of the apparatus to sense mechanical impedance.

In the fourth experiment accessing the ability of the apparatus to measure mechanical impedance of the soil as the unit moves vertically through the soil profile, a randomized complete block experimental design was also used. The experiment had four replications of two treatments. The treatments in this test were the direction of travel of the apparatus, i.e., either upward through the soil profile or downward through the soil profile.

For comparison, ten penetrometer measurements were randomly taken per plot with a hydraulically operated penetrometer. This penetrometer had a computer-based data acquisition system capable of measuring mechanical impedance every 5 mm through the soil profile to a depth of 600 mm. A cone with a base area of 323 $mm^2$ was used on the penetrometer. The penetrometer measurements were averaged for an overall plot mean for comparison against impedance readings collected with the inventive apparatus.

Bulk density was determined by taking undisturbed core samples (53 mm in diameter) from the top 300 mm of the soil, with a sliding hammer driven double cylinder undisturbed core sampler. Two replications of samples were taken between each plot on 50 mm intervals. The samples were weighed before drying so gravimetric and volumetric soil moisture content could be determined from the samples. The samples were then dried in a forced air convection oven for 72 hours at 105° C.

Results and Discussion

Evaluation of Tip Position on Impedance Measurements

The first test of the apparatus was designed to determine if the position of the prismatic sensing wedge relative to the tine affected measurements. Two tips were used in this test, the flush mounted 625 $mm^2$ tip and the 625 $mm^2$ tip which extended 30 mm in front of the tine.

Testing of the flush mounted tip was suspended after three test runs, because the force on the wedge at the shallow depth was below 10% of the full-scale capacity of the force transducer (Table 1). This low force level was of concern because the inherent variation of force transducers may be near 5% of the full scale measurement capacity. Therefore, in one data set, more than 50% of the measured force on the transducer could have been error. The force on the wedge increased at a deeper depth (325 mm) to near 20% full scale transducer capacity.

When the flush mounted tip was replaced with the extended tip, force values were increased sufficiently at all depths to allow valid data to be obtained from the apparatus (Table 1). A statistical comparison of the measurements using the inventive apparatus to measurements taken with the cone penetrometer could not be performed, because the mechanical impedance of the soil was beyond the measurement capacity of the cone penetrometer. In subsequent tests, a penetrometer with more measurement capacity was used.

Results from this experiment favored the tip extended in front of the tine in the soil conditions tested. The 625 $mm^2$ tip flush with the front of the tine did not encounter sufficient force to obtain accurate data at a shallow test depth (175 mm), however valid data was obtained at the deeper test depth of 325 mm. Based on these findings the 625 $mm^2$ extended tip was used in further tests.

Test of the Extended 625 $mm^2$ Impedance Sensing Tip at Static Depths

The apparatus was operated at four static depths to determine if the ability of the unit to determine mechanical impedance was affected by depth of operation. To accomplish this, the measurements were compared to cone penetrometer measurements at the depth of operation. The term "wedge index" was coined to describe mechanical impedance as measured with a prismatic wedge. Wedge index is described as the force measured on the wedge divided by the area of the base of the wedge. This is a similar index to cone index as described in ASAE standard S313.2 (ASAE, 1998). The cone index values were averaged over the effective depth range of the tip, i.e., the tip was 25-mm wide, therefore the cone index used to compare to the wedge index was the average cone index across the depths measured by the tip of the inventive apparatus.

The wedge index measurements exhibited a fair amount of variability in the data collected within each plot. The data indicated a cyclic pattern of force measurement. This phenomena was in agreement with other research findings of cyclic patterns to soil-tool draft data (Gill and Vandenburg, 1968). The data became less variable toward the end of the test run; this was likely caused by soil accumulating between the impedance sensing tip and the tine and preventing free travel of the impedance sensing.

The mechanical impedance values, as measured with the inventive apparatus were found to be less than mechanical impedance values measured with the cone penetrometer, which agrees with the findings of Alihamsyah et al. (1990, ibid). Differences in soil shear patterns created by the two tips could be the major reason for reduced impedance values. The prismatic wedge design displaced soil laterally, so it was only loaded on the side of the wedge. In contrast, the cone displaced soil in all directions, and was therefore loaded from all directions. This additional loading would likely cause higher impedance to be encountered.

Soil moisture is an important factor which affects cone index measurements (Mulqueen et al., 1977). This is evident in the cone index data at the 250-mm operating depth, where the measurements varied by more than 2 MPa. However, the measurements with the inventive apparatus did not have the same variation pattern. Although there was some variation in data it did not tend to be affected to the extent that the cone penetrometer measurements were effected.

Depth affected the ability of the inventive apparatus to detect mechanical impedance, and this was evident by examining the difference between the apparatus and cone penetrometer measurements at the different depths. Wedge index was approximately 50% less than cone index at the 100-mm depth, however at the 175 mm depth (below the level of surface compaction), the two indexes approached unity. At operating depths deeper than 175 mm, the cone index again tended to be of greater magnitude than the wedge index.

Regression analysis was used to relate the measurements of the apparatus to measurements made with the cone penetrometer. A linear equation as follows was used to describe the relationship:

$$\text{Cone Index}=1.52*\text{Wedge Index}.$$

This model was found significant ($P \leqq 0.0001$), with an $R^2$ of 0.65. All the data fell within the ninety-fifth percentile confidence limits.

Force values on the force transducer were still low at the shallow depths. After evaluating the data, the size of the impedance sensing tip was increased to increase the force on the transducer, allowing measurements of mechanical impedance near the soil surface to be obtained with greater accuracy. Test of the 2500 $mm^2$ Impedance Sensing Tip at Static Depths The inventive apparatus was again operated at four static depths of 100 mm, 175 mm, 250 mm and 325 mm. The force values recorded by the force transducer in this test exhibited a more defined cyclic pattern than the force values in the previous test. The shape of the 2500 $mm^2$ impedance sensing tip tended to prevent soil from wedging between the tip and the tine, and thus the reduction measurement variation was not observed in this test.

The data from the apparatus was determined to exhibit less variability than the cone penetrometer data. This observation was consistent with observations in the first two tests. Mechanical impedance as measured with the cone penetrometer was greater in this test than in the second test. However, the wedge index measured in this test was lower than the wedge index measured in the second test .

The increase in cone index values was likely caused by reduced soil moisture content in this test as compared to the previous test with the 625 $mm^2$ impedance tip (Tables 2 & 3). These results agree with work of other researches who determined that moisture content inversely affects cone index readings (Blanchar et al., 1978, Cassel, 1983, Thangavadivelu et al., 1992).

The bulk density was also reduced in this experiment compared to the experiment with the 625-$mm^2$ impedance sensing tip (Tables 2 & 3). The decrease in bulk density is believed to be a plausible explanation for the decrease in wedge index between the 2500-$mm^2$ and the extended 625-$mm^2$ impedance tip tests. The results of this test indicate that the apparatus may be more sensitive to bulk density changes and less sensitive to moisture changes, while the cone penetrometer data indicated an opposite trend.

Regression analysis was performed on the two mechanical impedance measurements to determine if a favorable relationship existed between the two methods. A linear relationship was found to exist between the wedge index and cone index. The following equation describes the linear relationship:

$$\text{Cone Index}=2.99*\text{Wedge Index}.$$

This relationship was found to be significant ($P \geqq 0.0001$) with an $R^2$ of 0.83. Since both measurement methods are empirical and are affected differently by different factors, an absolute equation to relate the two measurements may not be possible. The 2500-$mm^2$ impedance tip more closely correlated to cone penetrometer measurements than the 625-$mm^2$ impedance tip, and was therefore selected as the best choice for dynamic mechanical impedance testing.

Dynamic Testing with the 2500 $mm^2$ Impedance Sensing Tip

To determine if the apparatus was capable of dynamic measurement of mechanical impedance profiles, it was moved vertically through the soil profile at a rate of 0.1 m per meter of horizontal travel, as it was moved forward at 0.45 m/s. The wedge index data obtained from the apparatus unit was compared to cone index data collected with the cone penetrometer to determine if direction of travel affected wedge index data. The results of the regression analysis did not indicate that direction of travel affected wedge index readings.

The trend in previous tests of a depth effect on the apparatus measurements was again observed in this test. While the apparatus was found to be less effective in acquiring accurate impedance data at depths less than 150 mm in the soil used in these tests, it was found to predict a similar mechanical impedance curve to the curve predicted by the cone penetrometer at depths greater than 150 mm. At depths greater than 150 mm, both measurement methods predicted the maximum impedance within 5 mm of each other, the inventive apparatus predicted the maximum impedance to be at a depth of 265 mm and the cone penetrometer predicted the maximum impedance at 270 mm.

The wedge index did not have a strong correlation to cone index, when the depth of operation was less than 150 mm in the soil tested. However, the wedge index was found to favorably agree with the cone index in this experiment, at depths greater than 150 mm.

Wedge index was found to be more closely related ($P \geqq 0.0001$, $R^2=0.76$) to 50 mm bulk density averages than the cone penetrometer. The cone penetrometer measurements were found to be related to the 50-mm bulk density average, however, the relationship was not as linear ($P \geqq 0.0001$, $R^2=0.52$). The linear relationship between bulk density and wedge index was strengthened when the depth effect was taken into account. The relationship between bulk density and cone index was adversely affected when the depth effect on wedge index was taken into consideration. This relationship of wedge index to bulk density must be considered carefully, because bulk density was determined on 50-mm depth increments and specific bulk density at distinct depths within the 50 mm average could vary substantially. The apparatus does, however, follow the average well, and could be useful in quick determination of bulk density profiles of the soil.

Conclusions

The apparatus of the invention was able to predict the bulk density profile in the soil, which is the physical soil property modified to reduce soil compaction. The measurements also agreed favorably with cone penetrometer measurements of the soil profile at depths greater than 150 mm. The apparatus was determined to be less influenced by moisture content of the soil. Therefore, it was more closely correlated to bulk density than the cone penetrometer, and may be more suited for soil compaction measurements than a cone penetrometer.

It is understood that the foregoing detailed description is given merely by way of illustration and that modifications and variations may be made therein without departing from the spirit and scope of the invention.

TABLE 1

Effects of tip position and depth on force measurements with the OMIS.

| Tip Position | Depth mm | Force Measured kN | Transducer Loading % Full Scale |
|---|---|---|---|
| Flush | 175 | 0.34 | 7.6 |
| | 325 | 0.87 | 19.6 |
| Extended 30 mm | 100 | 0.49 | 11.0 |
| | 175 | 0.64 | 14.4 |
| | 250 | 1.48 | 33.3 |
| | 325 | 1.42 | 32.0 |

Statistical analysis not performed on the data due to insufficient replication.

TABLE 2

Bulk Density and Moisture content of 625 $mm^2$ ext. impedance sensing tip test.

| Depth mm | Bulk Density g/cm | Gravimetric Moisture Content g/g |
|---|---|---|
| 0–50 | 1.72 | 0.0725 |
| 50–100 | 1.87 | 0.0806 |
| 100–150 | 1.85 | 0.0861 |
| 150–200 | 1.84 | 0.0874 |

TABLE 2-continued

Bulk Density and Moisture content of 625 $mm^2$ ext. impedance sensing tip test.

| Depth mm | Bulk Density g/cm | Gravimetric Moisture Content g/g |
|---|---|---|
| 200–250 | 2.01 | 0.0888 |
| 250–300 | 2.02 | 0.0875 |
| LSD ($\alpha$ = 0.05) | 0.04 | 0.0017 |
| STD Error | 0.02 | 0.0033 |

TABLE 3

Bulk Density and Moisture content of 2500 $mm^2$ impedance sensing tip test.

| Depth mm | Bulk Density $g/cm^3$ | Gravimetric Moisture Content g/g |
|---|---|---|
| 0–50 | 1.68 | 0.0683 |
| 50–100 | 1.75 | 0.0744 |
| 100–150 | 1.96 | 0.0786 |
| 150–200 | 1.95 | 0.0794 |
| 200–250 | 2.00 | 0.0811 |
| 250–300 | 1.95 | 0.0822 |
| LSD ($\alpha$ = 0.05) | 0.03 | 0.0017 |
| STD Error | 0.03 | 0.0013 |

We claim:

1. An apparatus for measuring the mechanical impedance of soil comprising:

a. a frame;

b. a probe mounted on said frame and extending downwardly therefrom, said probe having a leading edge exposed to soil when passed in a horizontal direction therethrough;

c. an impedance sensor positioned on said leading edge of said probe effective for sensing horizontal force exerted thereon as said probe is passed in a horizontal direction through said soil;

d. a load cell in communication with said impedance sensor;

e. a reciprocating drive effective for oscillating said probe up and down through said soil, as said probe is simultaneously passed horizontally through said soil.

2. The apparatus of claim 1 wherein said reciprocating drive is a cam.

3. The apparatus of claim 2 cause said cam is effective to cause said probe to move up or down through a vertical range which is between about 6 to 18 inches high for every 25 feet of horizontal movement of said probe through said soil.

4. The apparatus of claim 1 wherein said reciprocating drive is selected from the group consisting of at least one motor and an extensible/retractable reciprocating element and said apparatus further comprises a microprocessor in communication with and controlling said reciprocating drive, which said microprocessor is programmed to actuate said reciprocating drive to cause said probe to move up or down through a vertical range which is between about 6 to 18 inches high at least one time for every 25 feet of horizontal movement of said probe through said soil.

5. The apparatus of claim 4 wherein said reciprocating drive is said extensible/retractable reciprocating element and said microprocessor is programmed to extend and retract said extensible/retractable reciprocating element.

6. The apparatus of claim 4 wherein said reciprocating drive is said at least one motor.

7. The apparatus of claim 1 further comprising a recording means for recording said force exerted on said impedance sensor.

8. The apparatus of claim 1 wherein said probe extends substantially vertically from said frame.

9. A method for measuring the mechanical impedance of soil comprising:

a. providing a mechanical impedance detector comprising a probe having a leading edge which is exposed to soil when passed in a horizontal direction therethrough, an impedance sensor positioned on said leading edge of said probe effective for sensing horizontal force thereon as said probe is passed horizontally through said soil, and a load cell in communication with said impedance sensor;

b. passing said mechanical impedance detector horizontally through said soil;

c. oscillating said probe up and down through said soil while said impedance sensor remains in said soil, simultaneously as said probe is passed horizontally through said soil; and d. measuring the mechanical impedance exerted upon said impedance sensor as said probe is passed horizontally and up and down through said soil.

10. The method of claim 9 wherein said probe is moved up or down through a vertical range which is between about 6 to 18 inches high at least one time for every 25 feet of horizontal movement of said probe through said soil.

11. The method of claim 9 further comprising recording said mechanical impedance exerted upon said impedance sensor.

* * * * *